US008899718B2

(12) United States Patent
Yamada et al.

(10) Patent No.: US 8,899,718 B2
(45) Date of Patent: Dec. 2, 2014

(54) PRINTED SEAMLESS CAN AND METHOD OF PRODUCING THE SAME

(75) Inventors: Koji Yamada, Yokohama (JP); Kenji Hayashi, Yokohama (JP); Shigenobu Murakami, Yokohama (JP); Zen Kanayama, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 13/825,244

(22) PCT Filed: Oct. 12, 2011

(86) PCT No.: PCT/JP2011/073441
§ 371 (c)(1),
(2), (4) Date: Mar. 20, 2013

(87) PCT Pub. No.: WO2012/053406
PCT Pub. Date: Apr. 26, 2012

(65) Prior Publication Data

US 2013/0176358 A1 Jul. 11, 2013

(30) Foreign Application Priority Data

Oct. 19, 2010 (JP) ..... 2010-234904

(51) Int. Cl.

| | |
|---|---|
| ***B41J 2/015*** | (2006.01) |
| ***B41J 2/01*** | (2006.01) |
| ***B41J 3/42*** | (2006.01) |
| ***B41J 3/44*** | (2006.01) |
| ***B41M 1/04*** | (2006.01) |
| ***B41M 1/06*** | (2006.01) |
| ***B41M 1/18*** | (2006.01) |
| ***B41M 1/40*** | (2006.01) |
| ***B41M 5/00*** | (2006.01) |
| ***B41M 7/02*** | (2006.01) |

(52) U.S. Cl.
CPC .... *B41J 2/01* (2013.01); *B41J 3/42* (2013.01); *B41J 3/44* (2013.01); *B41M 1/04* (2013.01); *B41M 1/06* (2013.01); *B41M 1/18* (2013.01); *B41M 1/40* (2013.01); *B41M 5/0088* (2013.01); *B41M 7/02* (2013.01)
USPC ..... 347/20; 347/101; 347/104

(58) Field of Classification Search
CPC ..... B41J 3/407; B41J 3/4073; B41J 3/283; B41J 3/286; B41J 3/42; B41J 3/44; B41J 3/54; B41J 3/60; B41J 2/01; B41M 1/18; B41M 1/40; B41M 5/0088
USPC ..... 347/20, 101–107
See application file for complete search history.

(56) References Cited

U.S. PATENT DOCUMENTS

| | | | | |
|---|---|---|---|---|
| 3,817,209 | A * | 6/1974 | Zurick | 118/258 |
| 7,905,174 | B2 | 3/2011 | Vetter et al. | |
| 2011/0165542 | A1* | 7/2011 | Campbell et al. | 434/219 |

FOREIGN PATENT DOCUMENTS

| | | | |
|---|---|---|---|
| JP | 57-43893 | A | 3/1982 |
| JP | 7-41718 | B2 | 5/1995 |

(Continued)

*Primary Examiner* — Juanita D Jackson
(74) *Attorney, Agent, or Firm* — Sughrue Mion, PLLC

(57) ABSTRACT

To provide printed seamless cans in small lots having many kinds of designs, the printed seamless cans excellently reproducing the density of the area solidly printed all over the surface and forming vivid images.
[Means for Solution] A printed seamless can forming at least a printed layer and a finishing varnish layer on at least the body portion on the outer surface of the seamless can, the printed layer having an image formed by the plate-type printing and an image formed by the ink-jet printing, and being covered with the finishing varnish layer.

14 Claims, 11 Drawing Sheets

(56) References Cited

FOREIGN PATENT DOCUMENTS

| | | | |
|---|---|---|---|
| JP | 2555697 | B2 | 11/1996 |
| JP | 10-291539 | A | 11/1998 |
| JP | 2002-205743 | A | 7/2002 |
| JP | 2003-84698 | A | 3/2003 |
| JP | 2004-42464 | A | 2/2004 |
| JP | 2004-98309 | A | 4/2004 |
| JP | 2005-165647 | A | 6/2005 |
| JP | 2005-531428 | A | 10/2005 |
| JP | 3713966 | B2 | 11/2005 |
| JP | 2006-96381 | A | 4/2006 |
| JP | 2006224586 | A | 8/2006 |
| JP | 2008-62455 | A | 3/2008 |
| JP | 2008-97228 | A | 4/2008 |
| JP | 149037 | * | 7/2009 |
| JP | 2009-234656 | A | 10/2009 |
| WO | 2010016503 | A1 | 11/2010 |

* cited by examiner

PRINTED SEAMLESS CAN AND METHOD OF PRODUCING THE SAME

CROSS REFERENCE TO RELATED APPLICATIONS

This application is a National Stage of International Application No. PCT/JP2011/073441, filed on Oct. 12, 2011, which claims priority from Japanese Patent Application No. 2010-234904, filed on Oct. 19, 2010, the contents of all of which are incorporated herein by reference in their entirety.

TECHNICAL FIELD

This invention relates to a printed seamless can and to a method of producing the same. More specifically, the invention relates to a seamless can having an image printed by the plate-type printing and the ink-jet printing and to a method of producing the same.

BACKGROUND ART

Seamless cans made from a metal such as aluminum or steel have large shock resistance and do not permit gases such as oxygen to pass through, offer such advantages as far superior preservability of the contents to the plastic containers as well as small weight as compared to glass bottles, and have been widely used as containers for containing carbonated beverages, alcohol beverages and many other beverages and foods.

Trade names and a variety of designs have been printed on the outer surfaces of the seamless cans by the plate-type printing method using a printing plate, such as offset printing (patent document 1) and by the ink-jet printing without using the plate (patent document 2).

There has, further, been proposed a printing system based on a combination of the plate-type printing and the ink-jet printing (patent document 3).

PRIOR ART DOCUMENTS

Patent Documents

Patent document 1: JP-A-2008-62455
Patent document 2: JP-A-2004-42464
Patent document 3: JP-T-2005-531428

OUTLINE OF THE INVENTION

Problems that the Invention is to Solve

The plate-type printing executes a multi-color printing by preparing plates for each of the ink colors, and is efficient when the seamless cans having the same image are to be mass-produced. When the design being printed is to be changed, however, the plates must be newly prepared. Namely, the plate-type printing requires an extended period of time for changing the design, has no freedom for changing the design that is to be printed, and can print only limited kinds of designs.

The ink-jet printing, on the other hand, requires no plate offering such advantages that the design to be printed can be freely changed in short periods of time (variableness), that the ink can be thickly printed enabling images with deepness to be formed and that highly fine images such as photographs can be excellently reproduced. However, the printing system is based on a principle of impinging ink droplets injected from ink heads poorly reproducing the density of the area solidly printed all over the surface (hereinafter often referred to as "dimming of the area solidly printed all over the surface") and imposing limitation on the speed of printing due to the limitation on the width of the heads and on the frequency of ejecting liquid droplets.

Though the seamless cans have now been mass-produced having the same design on the outer surfaces thereof as beverage cans and artistic cans, it is also a demand to produce the seamless cans in small lots having different designs. It has, therefore, been desired to provide a method of producing printed seamless cans that excellently reproduces the density of the area solidly printed all over the surface, that offers a large degree of freedom for designing the printing and that is capable of producing printed seamless cans in small lots having many kinds of designs.

It has been expected that the printing system which is based on the combination of the plate-type printing and the ink-jet printing offers the advantages of the respective plate-type printing and the ink-jet printing. However, difficulty is involved in positioning the respectively printed images and in obtaining vivid images on the portions where the images are overlapping, and the system is still far from being satisfactory.

It is, therefore, an object of the present invention to provide printed seamless cans in small lots having many kinds of designs, the printed seamless cans excellently reproducing the density of the area solidly printed all over the surface and forming vivid images.

Another object of the present invention is to provide a production method which features variableness in producing printed seamless cans in small lots having many kinds of designs within short periods of time, and is capable of efficiently producing printed seamless cans excellently reproducing the density of the area solidly printed all over the surface and forming vivid images.

Means for Solving the Problems

According to the present invention, there is provided a printed seamless can forming at least a printed layer and a finishing varnish layer on at least the body portion on the outer surface of the seamless can, the printed layer having an image formed by the plate-type printing and an image formed by the ink-jet printing, and being covered with the finishing varnish layer.

In the printed seamless can of the present invention, it is desired that:

1. The seamless can has a white coating formed on the outer surface thereof;
2. An anchor coating is formed under the printed layer;
3. The printed layer has a portion where the image formed by the plate-type printing is overlapped by the image formed by the ink-jet printing;
4. On part of the image of the printed layer formed by the plate-type printing, a mark for positioning the can is formed for conducting the ink-jet printing; and
5. The mark for positioning the can is formed at a position that is concealed in the double-seaming after the step of double-seaming the can and the lid together.

According to the present invention, there is, further, provided a method of producing a printed seamless can by forming a printed layer on at least the body portion on the outer surface of the seamless can by the plate-type printing and by the ink-jet printing and, thereafter, forming a finishing varnish layer on the printed layer by applying a finishing varnish thereon.

According to the method of producing a printed seamless can of the present invention, it is desired that:

1. The image formed by the ink-jet printing is false-cured for every feed of ink of each color by the ink jet, and is fully cured after the inks of all colors are fed;
2. The false-curing is conducted simultaneously with the feed of ink of each color or immediately after the feed of ink of each color but before the feed of ink of a next color;
3. The printed layer is formed by conducting the ink-jet printing after the plate-type printing has been conducted;
4. The ink-jet printing is so conducted as to form a portion that overlaps the image formed by the plate-type printing;
5. On part of the image of the printed layer formed by the plate-type printing, a mark for positioning the can is formed for conducting the ink-jet printing;
6. The image formed by the plate-type printing is false-baked prior to the ink-jet printing; and
7. The seamless can has a white coating and/or an anchor coating on the outer surface thereof.

Effects of the Invention

According to the present invention which uses the plate-type printing and the ink-jet printing in combination, it is made possible to form an image excellently reproducing the density of the area solidly printed all over the surface by the plate-type printing and a variable image by the ink-jet printing in combination and, therefore, to produce the printed seamless cans in small lots having many kinds of designs that could not be realized by the plate-type printing alone and, further, excellently reproducing image densities that could not be accomplished by the ink-jet printing alone.

According to the present invention, further, the false-baking is conducted for false-curing the image that is printed earlier making it possible to provide the printed seamless cans having vivid images without blurring the ink even when the images are overlapping in some portions.

According to the present invention which uses the plate-type printing that is a contact-type printing system in combination with the non-contact-type ink-jet printing and, further, false-cure the image formed by the plate-type printing, it is made possible to vividly print, on the seamless cans, an image composed of the image formed by the plate-type printing and the image formed by the ink-jet printing thereon without blurring.

According to the present invention, further, it is made possible to print, on the seamless cans, an underlying image and an image of a pattern in combination and in an overlapped manner in order to impart decorative effect to the printed seamless cans by not only combining the underlying image with the image of pattern but also combining images of patterns together to enhance commercial value.

According to the method of producing the printed seamless cans of the present invention, it is made possible to efficiently produce the seamless cans having both the image excellently reproducing the density of the area solidly printed all over the surface by the plate-type printing and the variable image formed by the ink-jet printing.

According to the method of producing the printed seamless cans of the present invention, further, the design on the printed seamless cans can be easily changed in short periods of time without changing the plates for the plate-type printing but using the same design and changing only the image of a portion formed by the ink-jet printing.

MODE FOR CARRYING OUT THE INVENTION (Method of Producing Printed Seamless Cans)

The method of producing printed seamless cans of the present invention has an important feature in that a printed layer is formed on at least the body portion on the outer surface of a seamless can by the plate-type printing and the ink-jet printing and, thereafter, a finishing varnish layer is formed on the printed layer by applying a finishing varnish thereon.

In the present invention, there is no specific order for conducting the plate-type printing and the ink-jet printing onto the seamless can; i.e., the order may be suitably determined depending on the design.

Further, the plate-type printing and the ink-jet printing may be conducted by using independent printing apparatuses or may be conducted by using the same apparatus or a composite apparatus (hereinafter often referred to as "hybrid apparatus").

Figure 1:
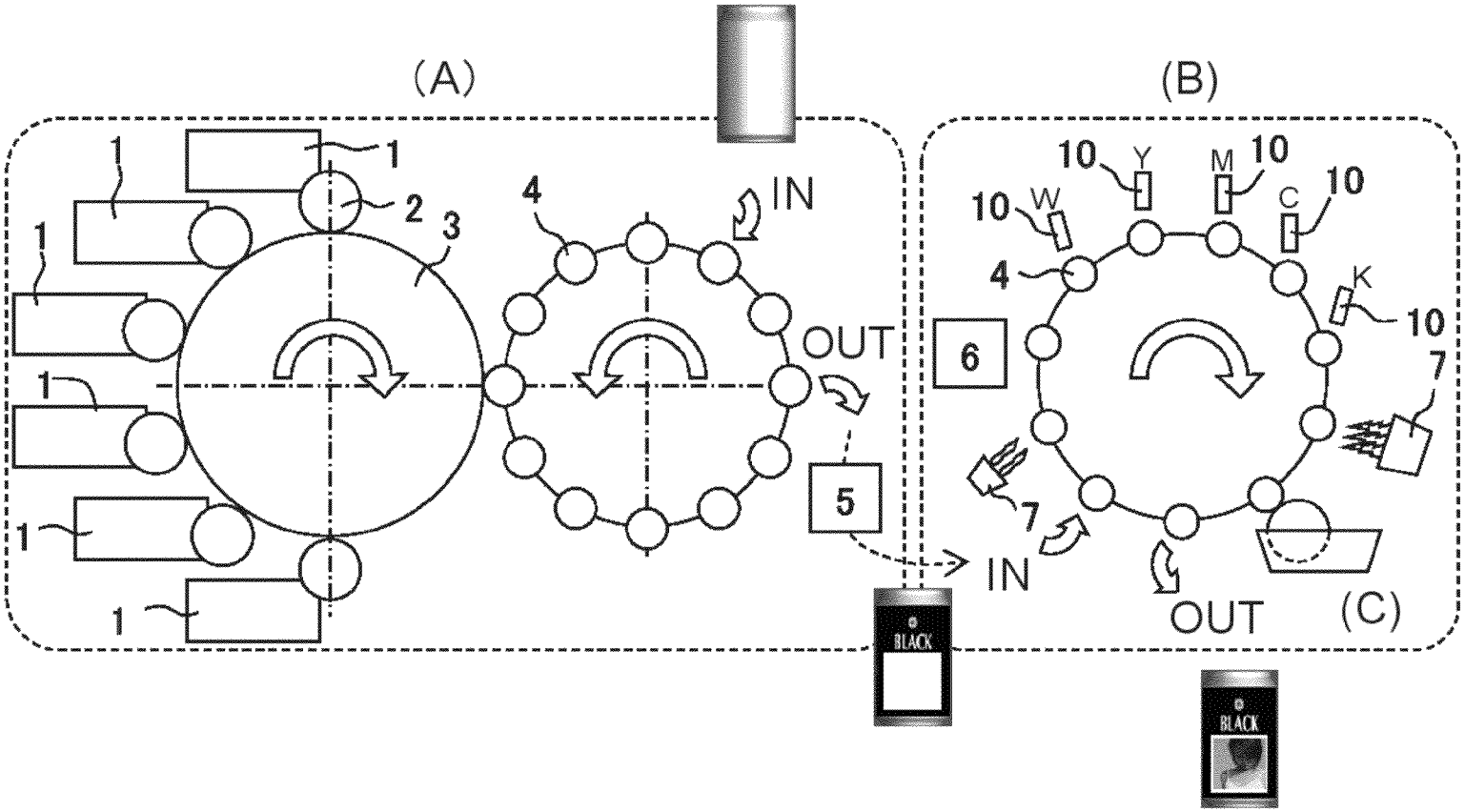
FIG. 1 is a drawing illustrating a printing system for conducting the plate-type printing and the ink-jet printing by using separate apparatuses for producing printed seamless cans of the present invention.
Figure 2:
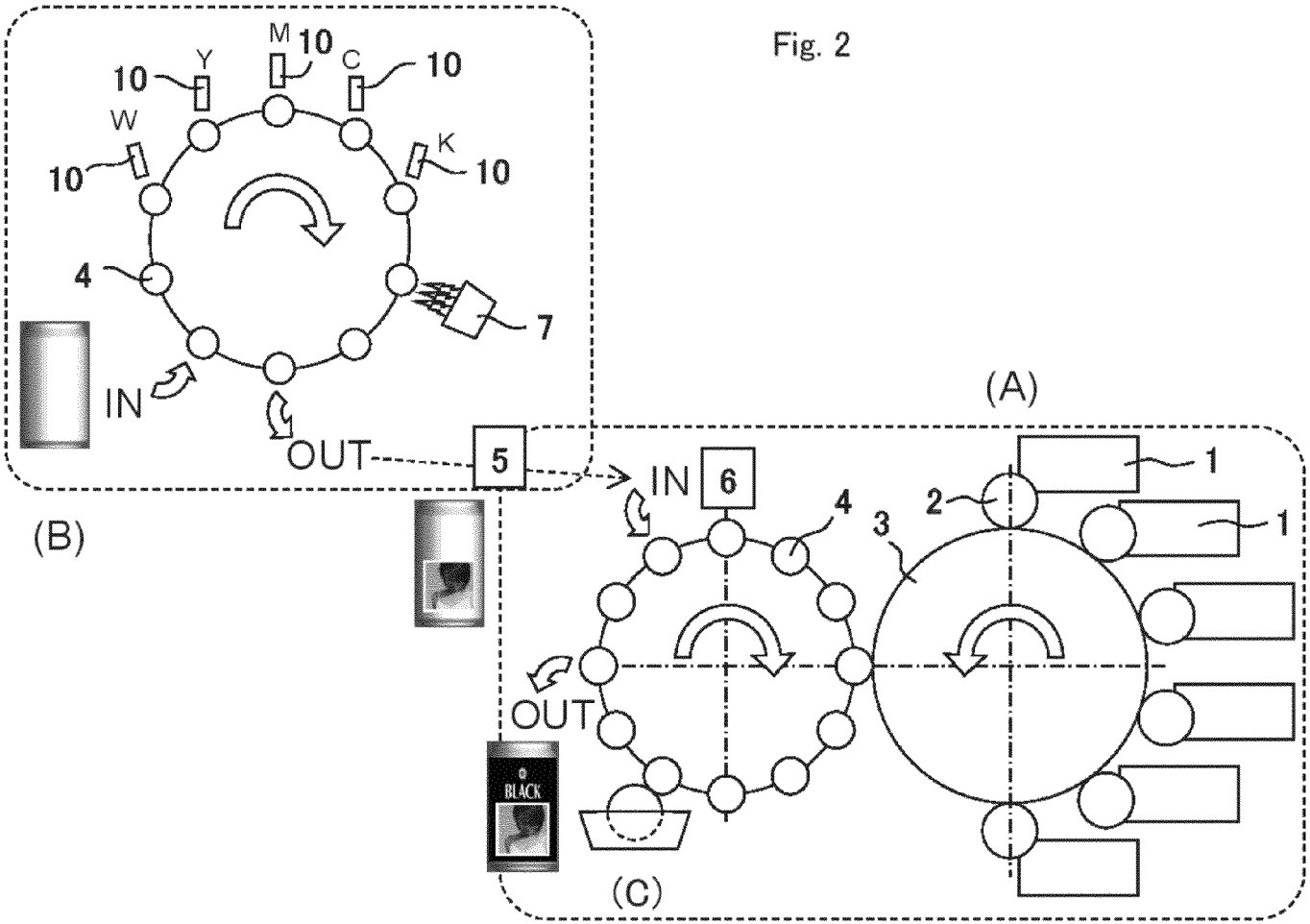
FIG. 2 is a drawing illustrating another printing system for conducting the plate-type printing and the ink-jet printing by using separate apparatuses for producing printed seamless cans of the present invention.

FIGS. 1 and 2 are diagrams illustrating the printing methods by using a plate-type printing apparatus (A) and an ink-jet printing apparatus (B) which are independent from each other. In FIG. 1, after the plate-type printing is conducted by the plate-type printing apparatus (A), the seamless can having a plate-printed image is conveyed by a conveying device 5 to the ink-jet printing apparatus (B) and is subjected to the ink-jet printing and to the finishing varnish coating (C). In FIG. 2, on the other hand, after the ink-jet printing is conducted by the ink-jet printing apparatus (B), the seamless can having an ink-jet-printed image is conveyed by the conveying device 5 to the plate-type printing apparatus (A) and is subjected to the plate-type printing and the finishing varnish coating (C).

Figure 3:
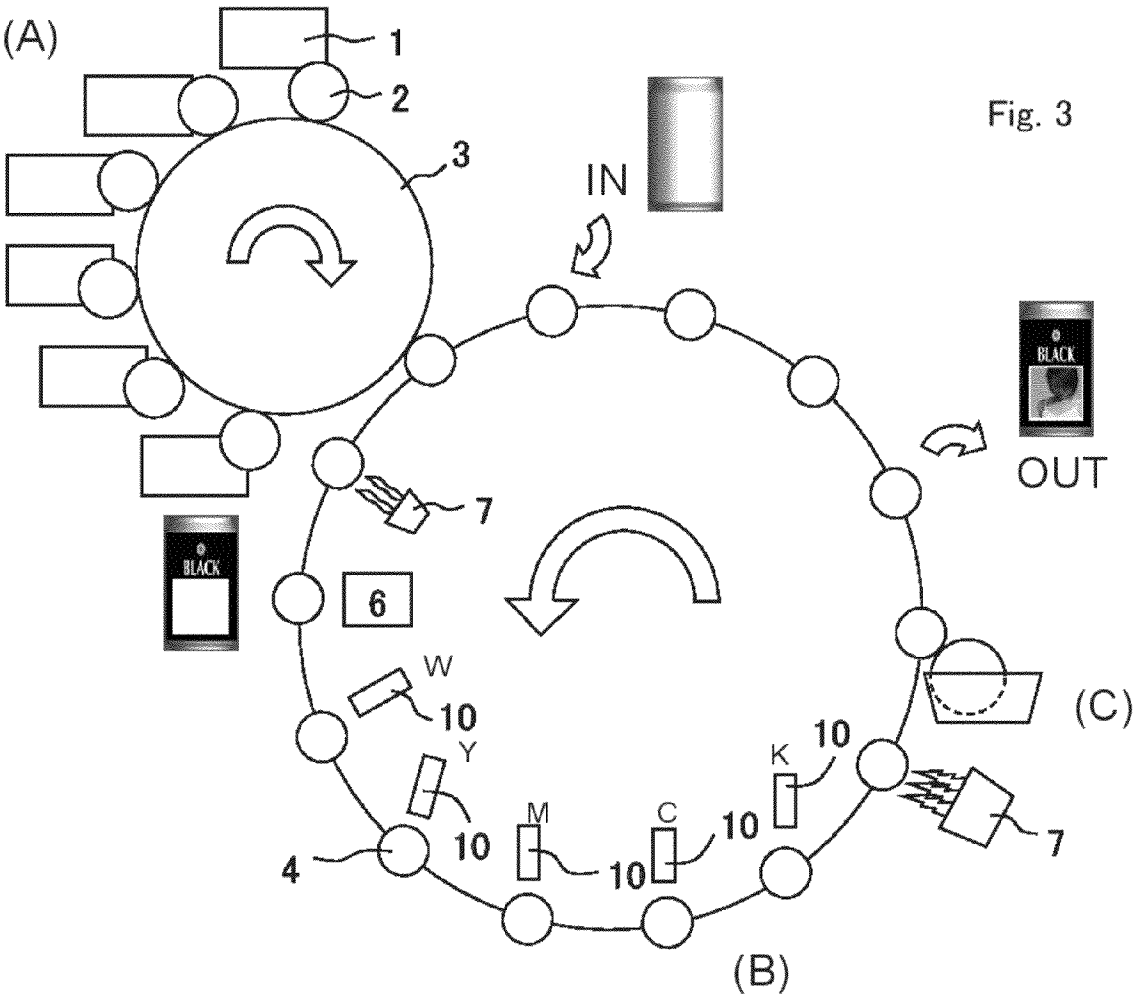
FIG. 3 is a drawing illustrating a printing system for conducting the plate-type printing and the ink-jet printing in the same apparatus for producing printed seamless cans of the present invention.
Figure 4:
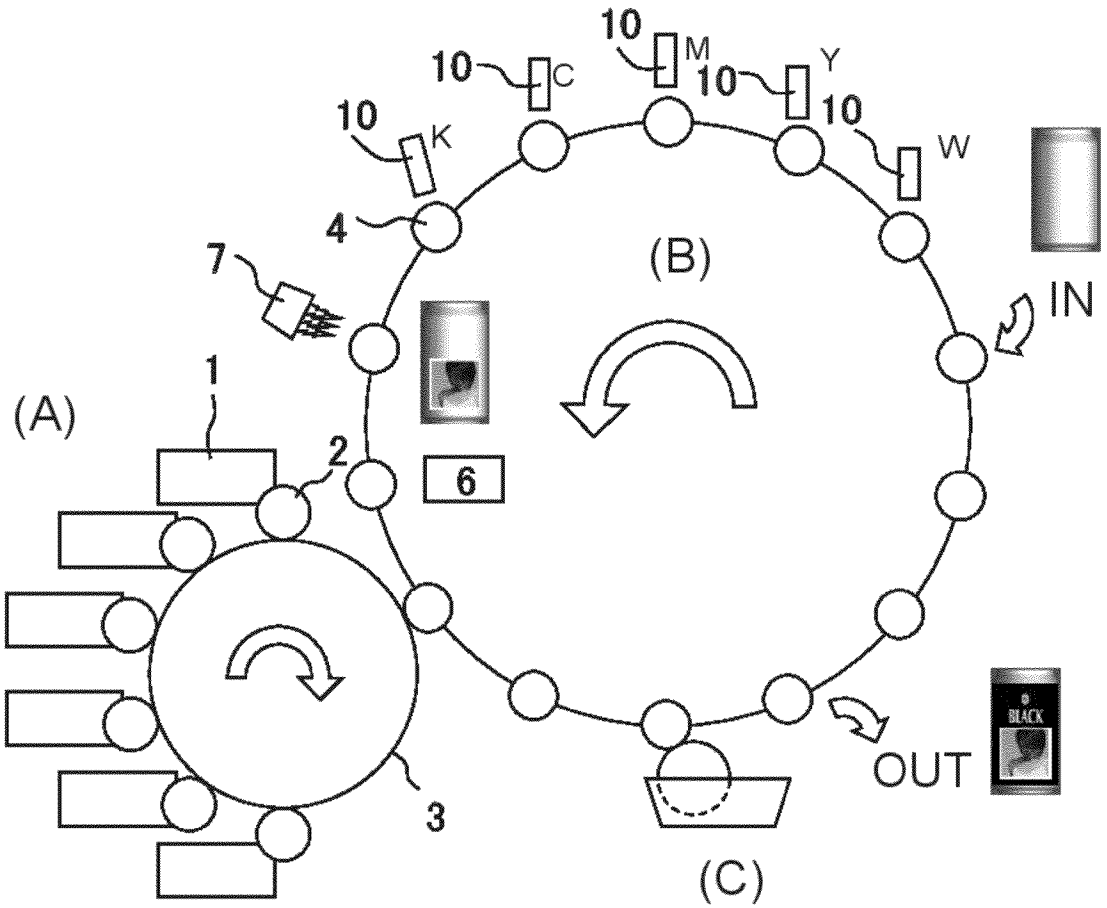
FIG. 4 is a drawing illustrating another printing system for conducting the plate-type printing and the ink-jet printing in the same apparatus for producing printed seamless cans of the present invention.
Figure 5:
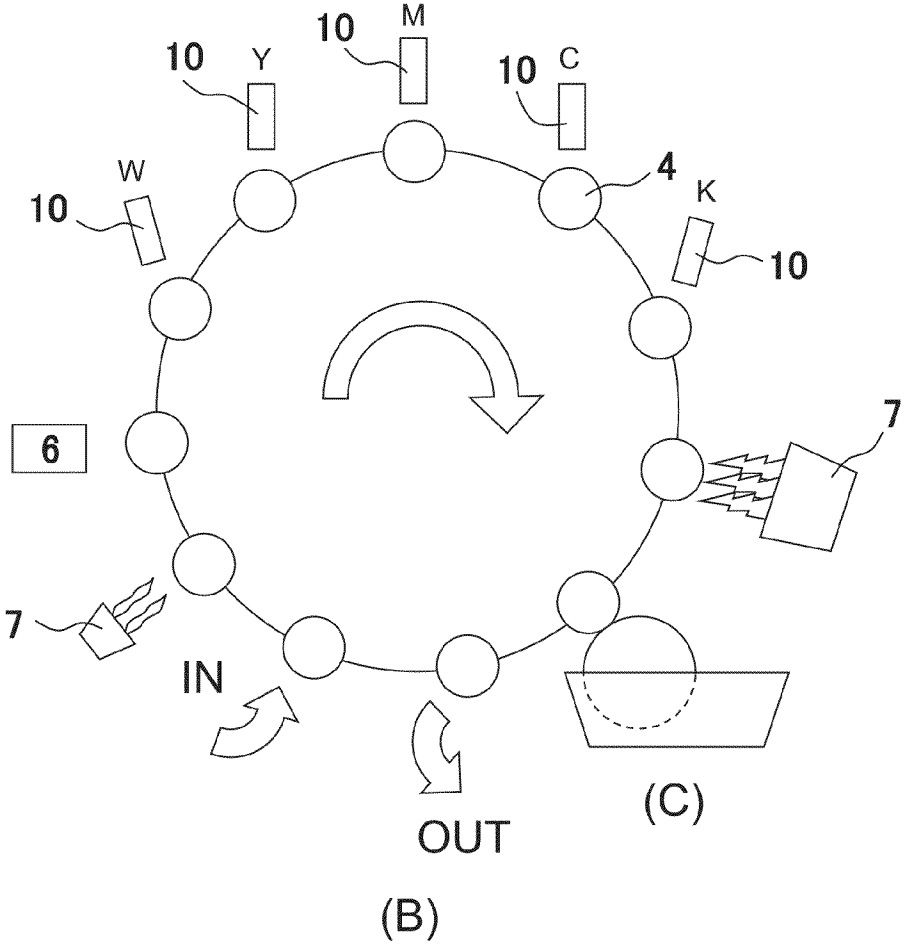
FIG. 5 is a drawing illustrating an example of timings for false baking in the ink-jet printing.
Figure 6:
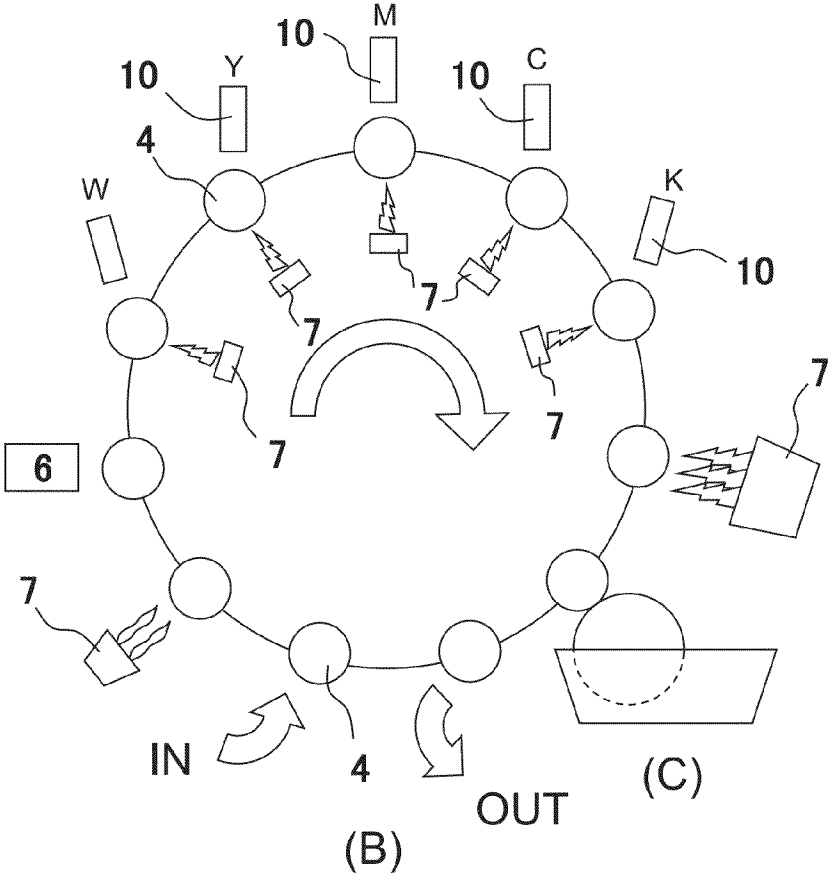
FIG. 6 is a drawing illustrating another example of timings for false baking in the ink-jet printing.
Figure 7:
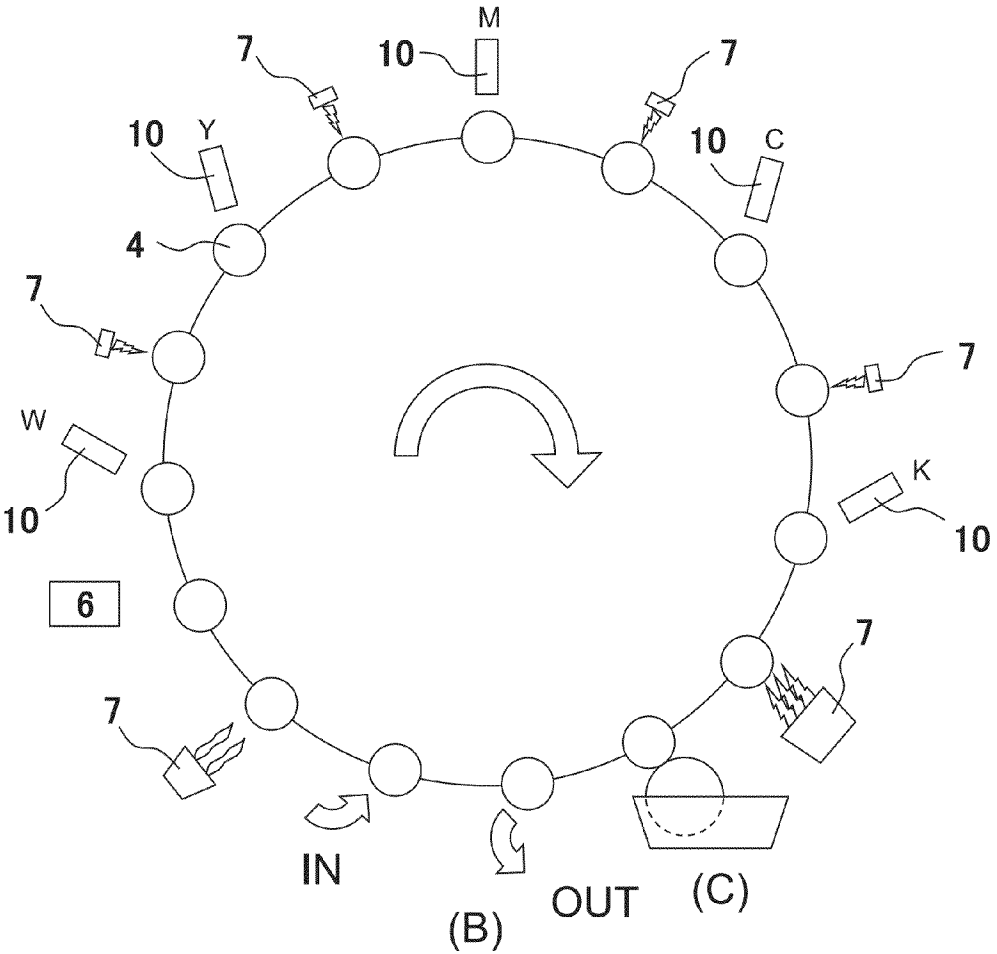
FIG. 7 is a drawing illustrating a further example of timings for false baking in the ink-jet printing.

FIGS. 3 and 4 are diagrams illustrating printing methods by using a hybrid apparatus in which the plate-type printing and the ink-jet printing are conducted in the same apparatus. In FIG. 3, the seamless can mounted on a mandrel 4 is, first, subjected to the plate-type printing and, thereafter, to the ink-jet printing and the finishing varnish coating (C). In FIG. 4, the seamless can mounted on the mandrel 4 is, first, subjected to the ink-jet printing and, thereafter, to the plate-type printing and the finishing varnish coating (C).

In any of the cases of FIGS. 1 to 4, there are employed the positioning as designated at 6 in the drawings and the false baking as designated at 7 in the drawings. The false baking and positioning will be described later.

In the method of producing printed seamless cans of the present invention, the printing can be conducted according to any order described above. From the standpoint of easy positioning and designing such as overlapped printing by the ink-jet printing, however, it is specifically preferred to conduct the plate-type printing first.

In this case, as will be described later, it is desired to false-cure the image formed first on the seamless can to suppress the ink from spreading. This prevents the ink from blurring on the portions where the images are overlapping, and a vivid image can be obtained.

Further, to print the image as desired, it is important to effect the positioning prior to conducting the next printing when the plate-type printing and the ink-jet printing are conducted either by using the separate printing apparatuses or by using the same printing apparatus. Therefore, a positioning mark is formed by the first printing. The positioning mark is detected prior to conducting the next printing, the seamless can is positioned by controlling the turn of the mandrel mounting the seamless can, and the desired image is printed maintaining good reproducibility.

The positioning mark may be formed at a plurality of places not at one place only. Instead of forming a special positioning mark, further, a portion of the printed image may be used as a mark for positioning, as a matter of course.

[Plate-Type Printing]

The plate-type printing employed for printing the seamless cans of the present invention may be the printing system such as relief printing or lithography that has heretofore been employed for printing the seamless cans and, specifically preferably, the offset printing.

As shown in FIGS. 1 to 4, the offset printing consists of feeding printing inks from ink feed units 1 to printing plates such as relief plates (not shown) on plate cylinders 2 and transferring the inks on the dots of the printing plates and on the image portion onto a blanket 3. The inks of all colors transferred onto the blanket 3 are further transferred onto the seamless cans mounted on mandrels 4 to thereby obtain the seamless cans printed by the plate-type printing.

When the plate-type printing is to be conducted prior to the ink-jet printing, it is desired that the inks are false-cured by false baking prior to conducting the ink-jet printing. This prevents the occurrence of blurring on the portions where the ink-jet printing overlaps the image.

When the plate-type printing is conducted first, it is desired that the image printed by the print-type printing forms, on a portion of it, a can-positioning mark for conducting the ink-jet printing. Specifically, it is desired that the mark is formed at a position that is concealed in the double-seamed portion after the step of double-seaming the can and the lid together.

The printing inks used for the plate-type printing of the present invention may be the printing inks that have heretofore been used for printing the seamless cans and, specifically, the inks of the heat-drying type (solvent type). When the ink-jet printing is conducted after the plate-type printing, though not absolutely necessary, it is desired to conduct the false baking depending on the concentrations of the inks prior to conducting the ink-jet printing. This suppresses the inks from spreading, and a vivid image can be obtained.

[Ink-Jet Printing]

The ink-jet printing employed for printing the seamless cans of the present invention may be the printing system that has heretofore been employed for printing the seamless cans.

As shown in FIGS. 1 to 4, the ink-jet printing consists of injecting the droplets of inks from ink-jet heads 10 corresponding to the inks of white (W), yellow (Y), magenta (M), cyan (C) and black (K) so as to print an image on the seamless cans mounted on the mandrels 4. Arrangement of the ink-jet heads of these colors is not limited to an example that is shown but may be in any order.

In the ink-jet printing, it is desired to false-cure the inks by false baking prior to the main curing that is conducted simultaneously with heat-curing the image printed by the plate-type printing and the finishing varnish. This prevents the inks from spreading or blurring even on a printing material that little absorbs the inks, such as the seamless can, and a sharp image can be formed.

Figure 8:
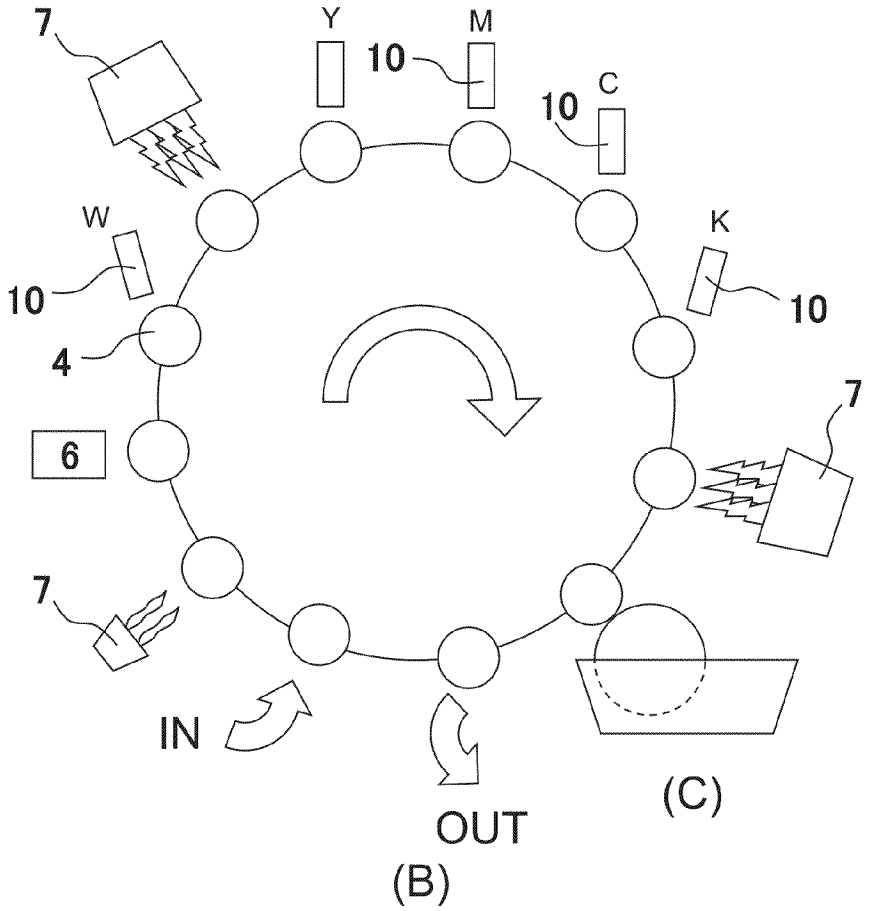
FIG. 8 is a drawing illustrating a still further example of timings for false baking in the ink-jet printing.

FIGS. 5 to 8 are diagrams illustrating the timings for false baking in the ink-jet printing apparatus (B). The preferred timings for false baking designated at 7 in the drawings differ depending upon the image to be printed and the kinds of the inks used for the ink-jet printing. As shown in FIGS. 5 to 8, it is desired that the inks are false-cured (i) after the feed of inks of all colors (FIG. 5), (ii) immediately after the feed of each ink (FIG. 6), (iii) after the feed of each ink but before the feed of the next ink (FIG. 7), or (iv) two times immediately after the feed of the white ink and after the feed of inks of all colors (FIG. 8). In the embodiments of FIGS. 5 to 8, the plate-type printing is conducted first, and the ink-jet printing is conducted after the image printed by the plate-type printing is false-cured. When the ink-jet printing is conducted first, too, the timings for false-curing the ink-jet printing are the same as in the cases of FIGS. 5 to 8.

That is, the inks for ink-jet printing may be false-baked at any timings of (i) to (iv). From the economic standpoint, however, it is desired that the false-curing is conducted at the timings of (i) above.

Further, as will be described later, when no white coating is formed on the seamless can, it is desired to solidly form a white layer all over the surface by the white-ink-jet printing in order to vividly form the image by ink-jet. For this purpose, it is desired to false-bake the inks at the timings of (iv) above; i.e., false-bake the white ink that is fed first, feed the inks of other colors onto the white ink followed by false baking again prior to applying the finishing varnish.

The timings for false baking in the ink-jet printing apparatus (B) shown in FIGS. 5 to 8 can be applied to any of the ink-jet printing apparatuses (B) shown in FIGS. 1 to 4.

As the printing inks used for the ink-jet printing of the invention, there can be used heat-drying inks, heat-curing inks, ultraviolet ray-curing inks or electron ray-curing inks that have heretofore been used for ink-jet-printing the seamless cans. Among them, however, the heat-drying inks are preferred from such a standpoint that the facility for baking is inexpensive.

The heat-drying inks include those of the aqueous type, oil type and solvent type. Among them, the solvent types are preferred since the time needed for the curing is short.

As the system of the heads used for the ink-jet printing, further, there have been known electrostatic system, piezo system, bubble-jet system and the like system which can be used in the present invention without limitation.

[Applying the Finishing Varnish]

In producing the printed seamless can of the present invention, the images are formed by the plate-type printing and the ink-jet printing and, thereafter, the finishing varnish is applied as designated at (C) in FIGS. 1 to 4.

The present invention has an important feature in that the images formed by the plate-type printing and the ink-jet printing are both covered with the finishing varnish. This assures excellent adhesion of the printed images as well as scratch resistance of the printed seamless cans when the printed seamless cans are subjected to such workings as retort-sterilization and double-seaming or when they are rubbed by each other during the transit.

As the finishing varnish used for producing the printed seamless cans of the invention, there can be used a transparent coating material that has heretofore been used as a top coating of the printed seamless cans and, particularly preferably, coating material of the heat-curing type.

After the finishing varnish has been applied, when the heat-curing ink is used for forming images by the plate-type printing and the ink-jet printing simultaneously with the baking of the finishing varnish, the image formed by the ink-jet printing is baked to thereby produce the printed seamless cans of the present invention.

[Seamless Cans]

In the method of producing printed seamless cans of the present invention, though not limited thereto only, the seamless cans that are to be printed are those seamless cans made from various surface-treated steel plates such as tin-free steel sheets (TFS), steel sheets plated with tin or the like, light metal sheets such as of aluminum, or resin-coated metal sheets comprising the above metal sheets coated with a thermoplastic resin such as polyester resin, that are formed through conventional means such as draw/redraw working, bend-stretch working (stretching) based on the draw/redrawing, bend-stretch/ironing based on the draw/redrawing, draw/ironing, or impact-working of a light metal sheet.

It is, further, desired to form a white coating on the outer surface of the seamless can since it conceals the ground color of the metal sheet and enables the image to be vividly printed.

It is further desired to form an anchor coating on the white coating or on the outer surface of the seamless can when no white coating is formed thereon. Upon forming the anchor coating, the image formed by the ink-jet printing is firmly fixed and adheres more closely. The anchor coating, further, reduces the blurring of the ink that is jetted.

The anchor coating can be formed by a known method; i.e., applying a coating solution obtained by dispersing or dissolving a heat-curable, ultraviolet ray-curable or electron ray-curable transparent polyester resin, acrylic resin, epoxy resin or urethane resin in a predetermined solvent, drying the thus formed coating, and curing the coating by heating, by the irradiation with ultraviolet rays or by the irradiation with electron rays. Of them, a method of heat-curing a heat-curable resin is preferred from the standpoint of a wide range of selection.

The white coating can be similarly formed by adding a white pigment such as titanium dioxide to a coating solution comprising a resin exemplified above for forming the anchor coating. A preferred method comprises heat-curing a coating solution obtained by dispersing or dissolving the heat-curable resin in a solvent.

It is desired that the thickness of the white coating is in a range of 0.1 to 10 μm and, specifically, 0.5 to 5 μm from the standpoint of concealing the ground color and that the thickness of the anchor coating is in a range of 0.1 to 5 μm and, specifically, 0.1 to 2 μm.

The same effect can be obtained even by forming a white resin coating that contains a white pigment on the metal sheet instead of forming the white coating.

(Printed Seamless Cans)

The printed seamless cans of the present invention have an important feature in that the images are formed by the plate-type printing and the ink-jet printing and are covered with a finishing varnish layer on at least the body portion on the outer surface of various seamless cans mentioned above.

Figure 9:
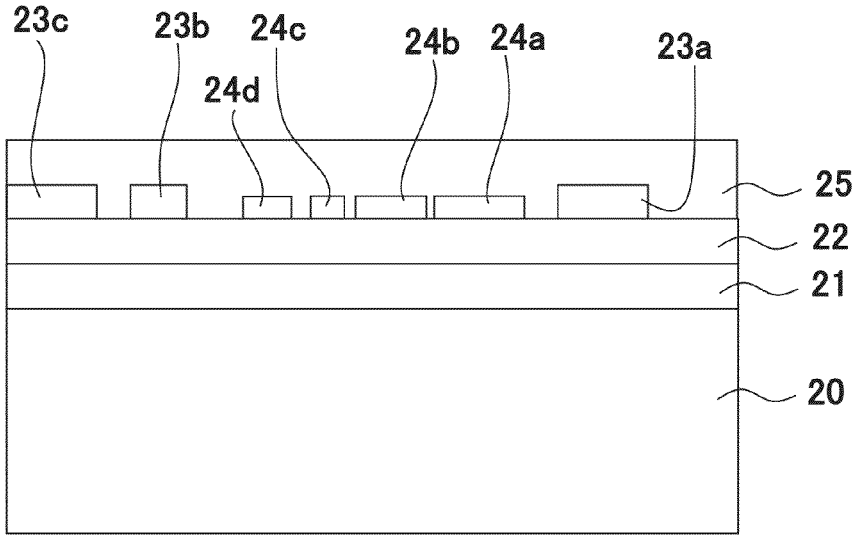
FIG. 9 is a view illustrating a sectional structure of the body portion of the printed seamless can of the invention.

FIG. 9 is a view illustrating a sectional structure of the body portion of the printed seamless can of the invention and in which a white coating 21 is formed on the outer surface of a can wall 20, and an anchor coating 22 is formed on the white coating 21. On the anchor coating 22, there are formed inks 23*a*, 23*b*, 23*c* being transferred by the plate-type printing and inks 24*a*, 24*b*, 24*c*, 24*d* being injected by the ink-jet printing. Further, the finishing varnish layer 25 is formed so as to completely cover both the inks 23 formed by the plate-type printing and the inks 24 formed by the ink-jet printing.

Figure 10:
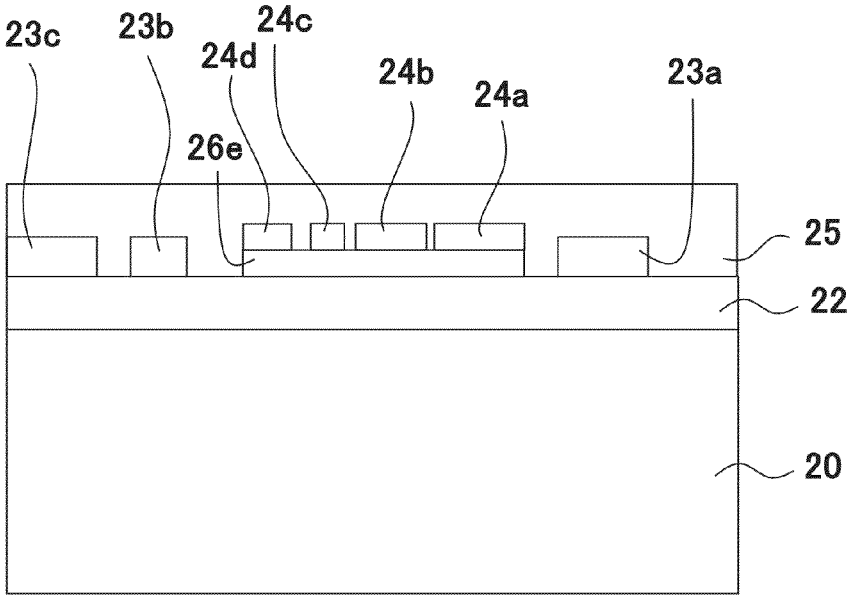
FIG. 10 is a view illustrating another sectional structure of the body portion of the printed seamless can of the invention.

Referring to another sectional structure of the body portion of the printed seamless can of the invention shown in FIG. 10, no white coating is formed but the anchor coating 22 is formed on the outer surface of the can wall 20. Further, the finishing varnish layer 25 is formed so as to completely cover both the inks 23 formed by the plate-type printing and the inks 24 formed by the ink-jet printing like in the case of FIG. 9. In FIG. 10, however, no white coating has been formed. In order to vividly form the image by the ink-jet printing, therefore, the inks 24*a*, 24*b*, 24*c* and 24*d* of colors other than white are applied onto the white ink 26*e* that is solidly formed all over the surface by the ink-jet printing. Here, the white ink 26*e* may not be solidly printed all over the surface but may be dot-printed.

Figure 11:
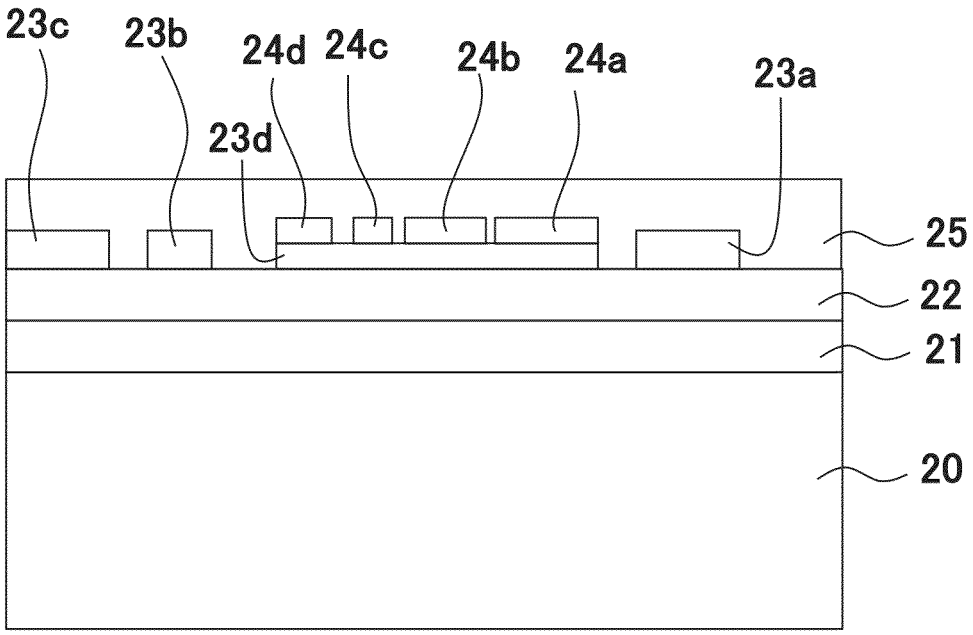
FIG. 11 is a view illustrating a further sectional structure of the body portion of the printed seamless can of the invention.

Referring to a further sectional structure of the body portion of the printed seamless can of the invention shown in FIG. 11, the white coating 21 is formed on the outer surface of the can wall 20, the anchor coating 22 is formed on the white coating 21, inks 23*a*, 23*b*, 23*c* are formed on the anchor coating 22 being transferred by the plate-type printing, inks 24*a*, 24*b*, 24*c*, 24*d* are formed being injected by the ink-jet printing, and the finishing varnish layer 25 is formed so as to completely cover both the inks 23 formed by the print-type printing and the inks 24 formed by the ink-jet printing in the same manner as in the case of FIG. 9. In this case, however, the inks 24*a*, 24*b*, 24*c*, 24*d* are applied by the ink-jet printing onto the ink 23*d* that is applied by the plate-type printing forming a portion where the image formed by the plate-type printing and the image formed by the ink-jet printing are overlapping one upon the other.

Figure 12:
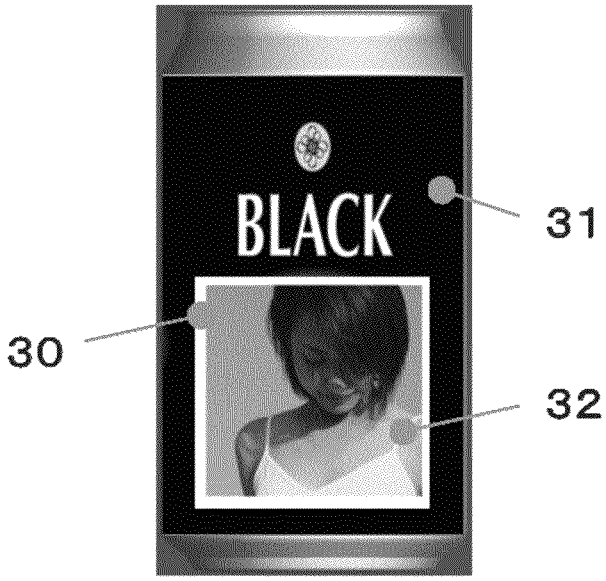
FIG. 12 is a photograph showing an image printed on the body portion of the seamless can of the invention.
Figure 13:
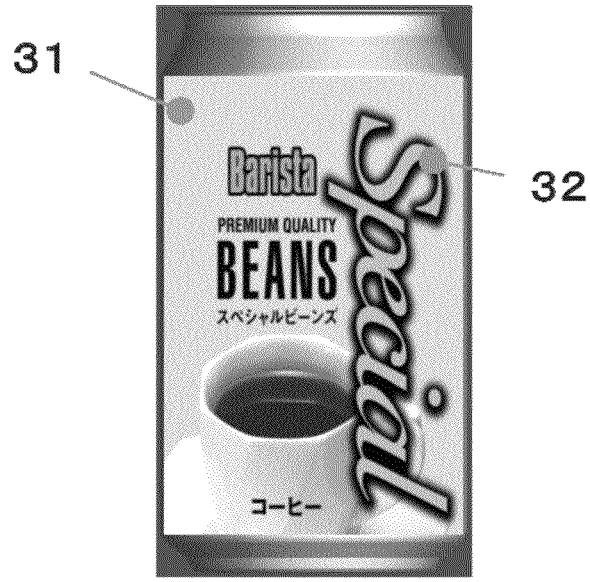
FIG. 13 is a photograph showing another image printed on the body portion of the seamless can of the invention.

FIGS. 12 and 13 are photographs showing embodiments of images printed on the body portions of the seamless cans of the invention. In the embodiment of FIG. 12, an image 31 is formed on nearly the whole surface of the can wall by the plate-type printing, the image 31 having a window portion 30 on where no image has been printed, and an image 32 is formed by the ink-jet printing on the window portion 30 where no image has been printed. In this embodiment, the image 31 formed by the plate-type printing and having a window portion 30 on where no image has been formed serves as a fixed design, and a variable design 32 is formed by the ink-jet printing on the window portion 30 on where no image has been formed, making it possible to form seamless cans on which a variable design is printed.

FIG. 13 shows the embodiment having a portion where an image is formed by the ink-jet printing on the image formed by the plate-type printing, i.e., the embodiment in which the image 31 is formed by the plate-type printing on the whole surface of the body portion of the seamless can and the image 32 is formed by the ink-jet printing on the image 31 that is formed by the plate-type printing. This embodiment, too, makes it possible to provide seamless cans on which various designs are printed by varying the image 32 formed by the ink-jet printing.

EXAMPLES

Example 1

A seamless can was produced by blanking an aluminum alloy sheet JIS3004 of a thickness of 0.30 mm in a customary manner, drawing the blank to form a cup, redraw-ironing the cup, trimming an opening portion thereof, washing the inner and outer surfaces thereof with an acid solution by using a washing machine, and washing the cup with industrial water and with de-ionized water followed by drying. An epoxy-type anchor coating was applied onto the outer surface of the obtained seamless can and was baked.

The seamless can was inserted in a mandrel of a hybrid printing apparatus shown in FIG. 3, and was fixed therein by vacuum produced from the inside of the mandrel. The plate-type printing (offset printing), positioning, ink-jet printing, false-baking and application of finishing varnish were conducted accompanying the intermittent rotation of the apparatus shown in FIG. 3, and the baking was conducted in an oven. The image formed by the ink-jet printing was false-baked at a timing shown in FIG. 8. The image was printed in a design (1) as shown in FIG. 12. No false-baking was conducted after the plate-type printing. Thereafter, the inner surface of the seamless can was coated and baked, and the opening portion of the seamless can was subjected to the necking and flanging to produce a 350-ml printed seamless can having a nominal can body diameter 211 and a nominal opening diameter 206. Details of the printing will be described below.

The image of the design (1) shown in FIG. 12 was printed, and in which the image dot-printed by ink jet was not overlapping the image solidly printed all over the surface by the offset printing. The hybrid printing apparatus was as shown in FIG. 3. In the plate-type printing, a solvent-type ink that could be dried upon heating was solidly printed all over the outer surface of the can wall from the relief plate of resin via the blanket. Here, a positioning mark 3 mm high and 10 mm wide was printed in black on the side of the opening portion. This portion was almost concealed in the double seamed portion of the lid after the content was filled.

After the plate-type printing has been finished, the positioning mark was detected by a camera, and the image formed by the plate-type printing was brought into agreement with the image formed by the ink-jet printing by turning the mandrel.

To form the image by the ink-jet printing, first, a white ink (W-color) was solidly ink-jet-printed and was false-baked with the hot air of 100° C. Next, dots were ink-jet-printed in order of yellow (Y-color), magenta (M-color), cyan (C-color) and black (K-color). Thereafter, the inks were baked at one time with the hot air of 100° C., the finishing varnish was applied thereon, and the baking was conducted at 200° C. for one minute in an oven. The inks that were jet-printed were of the solvent type that could be dried by heating.

The ink-jet head used for the ink-jet printing was of the single-head piezo type and was capable of printing the side wall of the seamless can over the whole height thereof. The seamless can was inserted and fixed in the mandrel so that the phases for printing Y-color, M-color, C-color and K-color were in agreement. The image to be printed had been programmed in a computer so as to be chromatically decomposed into Y-color, M-color, C-color and K-color, and reproduced with ink-jet-printed dots.

Tables 1 and 2 show the specifications of the outer surface and the evaluated results.

Example 2

A printed seamless can was produced in the same manner as in Example 1 but without conducting the false-baking with the hot air after the W-color printing by ink jet. Tables 1 and 2 show the specifications of the outer surface and the evaluated results. The ink blurred slightly on a portion where the image was dot-printed by ink jet on the white image solidly printed all over the surface by ink jet.

Example 3

A printed seamless can was produced in the same manner as in Example 1 but without applying the anchor coating on the outer surface of the wall of the seamless can. Tables 1 and 2 show the specifications of the outer surface and the evaluated results.

Example 4

A printed seamless can was produced in the same manner as in Example 1 by applying a heat-curable base coating (white coating) containing a titanium oxide pigment onto the outer surface of the wall of the seamless can followed by baking and applying an anchor coating thereon followed by baking but conducting neither the W-color printing all over the surface by ink jet nor the baking thereof with the hot air. Tables 1 and 2 show the specifications of the outer surface and the evaluated results.

Comparative Example 1

A printed seamless can was produced in the same manner as in Example 4 but without applying and baking the finishing varnish. Tables 1 and 2 show the specifications of the outer surface and the evaluated results.

Example 5

A printed seamless can was produced in the same manner as in Example 1 but conducting the ink-jet printing by using an ink of the ultraviolet ray-curable type and employing a baking means based on the irradiation of ultraviolet rays. Tables 1 and 2 show the specifications of the outer surface and the evaluated results.

Example 6

A printed seamless can was produced in the same manner as in Example 5 but without conducting the false-baking with the irradiation of ultraviolet rays after the W-color printing by ink jet. Tables 1 and 2 show the specifications of the outer surface and the evaluated results. The ink blurred slightly on a portion where the image was dot-printed by ink jet on the white image solidly printed all over the surface by ink jet.

Example 7

A printed seamless can was produced in the same manner as in Example 5 but irradiating the ultraviolet rays every after the printing of each color by ink jet. The image formed by the ink-jet printing was false-baked at a timing shown in FIG. 7. Tables 1 and 2 show the specifications of the outer surface and the evaluated results. The image dot-printed by ink jet was particularly vivid. The facility became bulky due to the provision of the ultraviolet ray irradiation apparatuses after the printing of each color by ink jet.

Example 8

A printed seamless can was produced in the same manner as in Example 5 by applying a heat-curable base coating (white coating) containing a titanium oxide pigment onto the outer surface of the wall of the seamless can followed by baking and applying an anchor coating thereon followed by baking but conducting neither the W-color solid printing all over the surface by ink jet nor the baking thereof with the ultraviolet rays. Tables 1 and 2 show the specifications of the outer surface and the evaluated results.

Example 9

A printed seamless can was produced in the same manner as in Example 1 but conducting the ink-jet printing by using inks of the electron ray-curable type and employing a baking means based on the irradiation of electron rays. Tables 1 and 2 show the specifications of the outer surface and the evaluated results.

Example 10

A printed seamless can was produced in the same manner as in Example 9 but without conducting the false-baking with the irradiation of electron rays after the W-color printing by ink jet. Tables 1 and 2 show the specifications of the outer surface and the evaluated results. The inks blurred slightly on a portion where the image was dot-printed by ink jet on the white image solidly printed all over the surface by ink jet.

Example 11

A printed seamless can was produced in the same manner as in Example 9 by applying a heat-curable base coating (white coating) containing a titanium oxide pigment onto the outer surface of the can wall followed by baking and applying an anchor coating thereon followed by baking but conducting neither the W-color solid printing all over the surface by ink jet nor the baking thereof by the irradiation with electron ray. Tables 1 and 2 show the specifications of the outer surface and the evaluated results.

Example 12

The image of the design (2) shown in FIG. 13 was printed, and in which the image printed (dot-printed) by ink jet was overlapping the image printed (solidly printed all over the surface) by the offset printing.

A heat-curable base coating (white coating) containing a titanium oxide pigment was applied onto the outer surface of the side wall of the seamless can followed by baking and, thereafter, an anchor coating was applied thereon followed by baking.

The seamless can was inserted and fixed in the mandrel of the apparatus shown in FIG. 3. The plate-type printing (offset printing), false baking of the plate-printed image (treatment with the hot air of 100° C.), positioning, ink-jet printing and false baking, and application of finishing varnish, were conducted accompanying the turn of the apparatus of FIG. 3, followed by baking in an oven. The image formed by the ink-jet printing was false-baked at a timing shown in FIG. 5. The ink-jet printing was conducted by using solvent-type inks that could be dried upon heating. Neither the W-color printing by ink jet nor the false baking thereof was conducted. In other respects, the procedure was the same as that in Example 1 to produce the printed seamless can. Tables 1 and 2 show the specifications of the outer surface and the evaluated results.

Example 13

A printed seamless can was produced in the same manner as in Example 12 but without false-baking the image formed by the plate-type printing. Tables 1 and 2 show the specifications of the outer surface and the evaluated results. The inks blurred slightly on a portion where the image was dot-printed by ink jet on the image formed by the plate-type printing.

Example 14

A printed seamless can was produced in the same manner as in Example 12 but conducting the ink-jet printing by using inks of the ultraviolet ray-curable type and employing a baking means based on the irradiation of ultraviolet rays. Tables 1 and 2 show the specifications of the outer surface and the evaluated results.

Example 15

A printed seamless can was produced in the same manner as in Example 14 but without false-baking the image formed by the plate-type printing. Tables 1 and 2 show the specifications of the outer surface and the evaluated results. The inks blurred slightly on a portion where the image was dot-printed by ink jet on the image formed by the plate-type printing.

Example 16

A printed seamless can was produced in the same manner as in Example 12 but conducting the ink-jet printing by using inks of the electron ray-curable type and employing a baking means based on the irradiation of electron rays. Tables 1 and 2 show the specifications of the outer surface and the evaluated results.

Example 17

A printed seamless can was produced in the same manner as in Example 16 but without false-baking the image formed by the plate-type printing. Tables 1 and 2 show the specifications of the outer surface and the evaluated results. The inks blurred slightly on a portion where the image was dot-printed by ink jet on the image formed by the plate-type printing.

Example 18

The apparatus shown in FIG. 1 was used as the printing apparatus. The image that was printed was the design (2) shown in FIG. 13.

The white coating and the anchor coating were formed on the outer surface of the seamless can like in Example 12. Thereafter, the seamless can was inserted and fixed in the mandrel of the plate-type printing apparatus shown in FIG. 1, and the image was printed by offset printing (plate-type printing) by using solvent-type inks that could be dried by heating. After the plate-type printing has been finished, the seamless can was conveyed to the ink-jet printing apparatus in a state where the bottom of the seamless can was sucked by vacuum from the outer surface side thereof and was fixed to the chuck, and was inserted in the mandrel of the ink-jet printing apparatus and was fixed thereto by vacuum. Next, the hot air of 100° C. was blown onto the side surface of the can wall to false-bake the printed image, and the mandrel was turned while detecting the positioning mark by using a camera so that the image to be formed by ink jet printing could be in agreement with the image formed by the plate-type printing. In other respects, the procedure was the same as that in Example 12 to produce the printed seamless can. The image formed by the ink-jet printing was false-baked at the timing shown in FIG. 5. Tables 1 and 2 show the specifications of the outer surface and the evaluated results. The facility became bulky since the plate-type printing apparatus and the ink-jet printing apparatus were formed as separate apparatuses, and a conveyer apparatus was provided between them.

Comparative Example 2

After having formed a white coating and an anchor coating on the outer surface of the seamless can, the plate-type printing was conducted by using the printing apparatus shown in FIG. 3 followed by false baking and, thereafter, an image was printed in four colors by ink jet. The image of the same design as the design (1) shown in FIG. 12 was printed, the fixed design being solidly printed all over the surface by ink jet and the variable design being dot-printed thereon by ink jet all in one step. In other respects, the procedure was the same as that in Example 4 to produce the printed seamless can. Tables 1 and 2 show the specifications of the outer surface and the evaluated results. The image solidly printed all over the surface by ink jet was dimming.

Comparative Example 3

A printed seamless can was produced in the same manner as in Comparative Example 2 but printing, in one step, an image of the same design as the design (2) shown in FIG. 13, the fixed design being solidly printed all over the surface by ink jet and the variable design being dot-printed by ink jet. Tables 1 and 2 show the specifications of the outer surface and the evaluated results. The image solidly printed all over the surface by ink jet was dimming.

Comparative Example 4

A printed seamless can was produced in the same manner as in Comparative Example 2 but printing, in one step, an image of the same design as the design (1) shown in FIG. 12 by the offset printing (plate-type printing) only. The ink-jet printing was not conducted. Tables 1 and 2 show the specifications of the outer surface and the evaluated results.

Comparative Example 5

A printed seamless can was produced in the same manner as in Comparative Example 3 but printing an image of the same design as the design (2) shown in FIG. 13 by the offset printing (plate-type printing) only. The ink-jet printing was not conducted. Tables 1 and 2 show the specifications of the outer surface and the evaluated results.

<Method of Evaluation>

(Evaluating the Quality of Printing)

The seamless cans that were produced were evaluated for their images printed thereon with the eye into four steps. The evaluation was on the basis of excellent (◎), good (○), fairly good (Δ) and defective (X). Evaluations ◎, ○ and Δ pertained to an allowable range. For the defective images, the reasons were added as described in Table 2.

(Luster of the Printed Surfaces)

The printed seamless cans that were produced were evaluated for their luster on the printed surfaces with the eye into three steps. The evaluation was on the basis of good (○), fairly good (Δ) and defective (X). Evaluations ○ and Δ pertained to an allowable range.

(Adhering Property after the Retort-Treatment)

The printed seamless cans that were produced were subjected to the retort-treatment with steam heated at 130° C. for 30 minutes. Thereafter, by using a cutter knife, six scratch lines were formed in each of the images of the offset-printed portion, ink-jet-printed portion and portion on where the ink-jet-printed portion overlapped the offset-printed portion maintaining a gap of 1 mm in the direction of height of the can and in the circumferential direction of the can to form a grid pattern consisting of 25 pieces. A cellophane tape (manufactured by Nichiban Co., registered trade name) was stuck thereto and was peeled off one time to evaluate the adhering property of the inks on the following basis of (○) when the peeling was less than 10%, (Δ) when the peeling was not less than 10% but was less than 50%, and (X) when the peeling was not less than 50%. Evaluations ○ and Δ pertained to an allowable range.

(Susceptibility of the Can Walls to Being Scratched)

The printed seamless cans that were produced were filled with tap water, double-seamed with lids, and were put in a carton (24-can carton) which was packed up. By using a three-direction simultaneous vibration testing apparatus (manufactured by Shinken Co.), vibration corresponding to 1 G was imparted to the cans in the longitudinal and transverse directions for 30 minutes each, and the scratched states of the printed surfaces were observed with the eye and evaluated into three steps. The basis of evaluation was as follows, ○ and Δ being regarded to be in an allowable range:

○: No can was scratched.

Δ: One to two cans were scratched only slightly.

X: Three or more cans were slightly scratched, or one or more cans were more severely scratched.

(Adhering Property at the Worked Portions)

By using a cutter knife, a scratch line was formed in the outer surfaces of the neck portions of the printed seamless cans that were produced along the whole circumference thereof. The printed seamless cans were subjected to the retort-treatment with steam heated at 130° C. for 30 minutes, and were observed with the eye if the printed film was peeling at the scratched portion to thereby evaluate the adhering property at the worked portion. There were evaluated n=10 cans. The evaluation was on the basis of (○) when less than 10% of the cans developed peeling, (Δ) when more than 10% but less than 50% of the cans developed peeling, and (X) when more than 50% of the cans developed peeling. Evaluations ○ and Δ pertained to an allowable range.

(Productivity)

Without changing the fixed designs, the variable designs only were changed in the designs (1) and (2) shown in FIGS. 12 and 13, and the time required for changing the design was evaluated. The evaluation was on the basis of ○ (short time) and X (long time). Δ was when the facility became bulky. Evaluations ○ and Δ pertained to an allowable range.

(Overall Evaluations)

In the above evaluations, i.e., in the (evaluation of the quality of printing), (luster of the printed surfaces), (adhering property after the retort-treatment), (susceptibility of can walls to being scratched), (adhering property at worked portions) and (productivity), the least appreciated points were regarded to be overall evaluations. Evaluations ○ and Δ pertained to an allowable range.

TABLE 2-continued

| | Evaluation | | | | | | |
|---|---|---|---|---|---|---|---|
| | *1 | *2 | *3 | *4 | *5 | *6 | *7 |
| Ex. 8 | ○ | ○ | ○ | ○ | ○ | ○ | ○ |
| Ex. 9 | ○ | ○ | ○ | ○ | ○ | ↑ | ○ |
| Ex. 10 | Δ (*8) | ○ | ○ | ○ | ○ | ↑ | Δ |
| Ex. 11 | ○ | ○ | ○ | ○ | ○ | ↑ | ○ |
| Ex. 12 | ○ | ○ | ○ | ○ | ○ | ↑ | ○ |
| Ex. 13 | Δ (*8) | ○ | ○ | ○ | ○ | ↑ | Δ |

TABLE 1

| | | Printed design | | | | | | | Ink-jet printing (IJP) | | | | | | | | | | | |
|---|---|---|---|---|---|---|---|---|---|---|---|---|---|---|---|---|---|---|---|---|
| | | Design (1) | | Design (2) | | | | *5 | | Printing step | | | | | False baking | | | | | Finishing |
| | Apparatus | *1 | *2 | *1 | *2 | *3 | *4 | *6 | Ink Type | W | Y | M | C | K | Means | *10 | *11 | *12 | *13 | *14 | varnish |
| Ex. 1 | FIG. 3 | offset | IJP | — | — | no | yes | no | *7 | ○ | ○ | ○ | ○ | ○ | hot air | ○ | — | — | — | ○ | yes |
| Ex. 2 | ↑ | offset | IJP | — | — | no | yes | no | *7 | ○ | ○ | ○ | ○ | ○ | hot air | — | — | — | — | ○ | yes |
| Ex. 3 | ↑ | offset | IJP | — | — | no | no | no | *7 | ○ | ○ | ○ | ○ | ○ | hot air | ○ | — | — | — | ○ | yes |
| Ex. 4 | ↑ | offset | IJP | — | — | yes | yes | no | *7 | — | ○ | ○ | ○ | ○ | hot air | — | — | — | — | ○ | yes |
| Comp. Ex. 1 | ↑ | offset | IJP | — | — | yes | yes | no | *7 | — | ○ | ○ | ○ | ○ | hot air | — | — | — | — | ○ | no |
| Ex. 5 | ↑ | offset | IJP | — | — | no | yes | no | UV | ○ | ○ | ○ | ○ | ○ | *8 | ○ | — | — | — | ○ | yes |
| Ex. 6 | ↑ | offset | IJP | — | — | no | yes | no | UV | ○ | ○ | ○ | ○ | ○ | *8 | — | — | — | — | ○ | yes |
| Ex. 7 | ↑ | offset | IJP | — | — | no | yes | no | UV | ○ | ○ | ○ | ○ | ○ | *8 | ○ | ○ | ○ | ○ | ○ | yes |
| Ex. 8 | ↑ | offset | IJP | — | — | yes | yes | no | UV | — | ○ | ○ | ○ | ○ | *8 | — | — | — | — | ○ | yes |
| Ex. 9 | ↑ | offset | IJP | — | — | no | yes | no | EB | ○ | ○ | ○ | ○ | ○ | *9 | ○ | — | — | — | ○ | yes |
| Ex. 10 | ↑ | offset | IJP | — | — | no | yes | no | EB | ○ | ○ | ○ | ○ | ○ | *9 | — | — | — | — | ○ | yes |
| Ex. 11 | ↑ | offset | IJP | — | — | yes | yes | no | EB | — | ○ | ○ | ○ | ○ | *9 | — | — | — | — | ○ | yes |
| Ex. 12 | ↑ | — | — | offset | IJP | yes | yes | yes | *7 | — | ○ | ○ | ○ | ○ | hot air | — | — | — | — | ○ | yes |
| Ex. 13 | ↑ | — | — | offset | IJP | yes | yes | no | *7 | — | ○ | ○ | ○ | ○ | hot air | — | — | — | — | ○ | yes |
| Ex. 14 | ↑ | — | — | offset | IJP | yes | yes | yes | UV | — | ○ | ○ | ○ | ○ | *8 | — | — | — | — | ○ | yes |
| Ex. 15 | ↑ | — | — | offset | IJP | yes | yes | no | UV | — | ○ | ○ | ○ | ○ | *8 | — | — | — | — | ○ | yes |
| Ex. 16 | ↑ | — | — | offset | IJP | yes | yes | yes | EB | — | ○ | ○ | ○ | ○ | *9 | — | — | — | — | ○ | yes |
| Ex. 17 | ↑ | — | — | offset | IJP | yes | yes | no | EB | — | ○ | ○ | ○ | ○ | *9 | — | — | — | — | ○ | yes |
| Ex. 18 | FIG. 1 | — | — | offset | IJP | yes | yes | yes | *7 | — | ○ | ○ | ○ | ○ | hot air | — | — | — | — | ○ | yes |
| Comp. Ex. 2 | FIG. 3 | IJP | IJP | — | — | yes | yes | no | *7 | — | ○ | ○ | ○ | ○ | hot air | — | — | — | — | ○ | yes |
| Comp. Ex. 3 | ↑ | — | — | IJP | IJP | yes | yes | no | *7 | — | ○ | ○ | ○ | ○ | hot air | — | — | — | — | ○ | yes |
| Comp. Ex. 4 | ↑ | offset | offset | — | — | yes | yes | no | — | — | — | — | — | — | — | — | — | — | — | — | yes |
| Comp. Ex. 5 | ↑ | — | — | offset | offset | yes | yes | no | — | — | — | — | — | — | — | — | — | — | — | — | yes |

*1: Fixed portion,
*2: Variable portion,
*3: White coating,
*4: Anchor coating,
*5: Offset printing,
*6: False baking,
*7: heat-drying,
*8: UV irradiation,
*9: EB irradiation,
*10: After W,
*11: After Y,
*12: After M,
*13: After C,
*14: After K

TABLE 2

| | Evaluation | | | | | | |
|---|---|---|---|---|---|---|---|
| | *1 | *2 | *3 | *4 | *5 | *6 | *7 |
| Ex. 1 | ○ | ○ | ○ | ○ | ○ | ○ | ○ |
| Ex. 2 | Δ (*8) | ○ | ○ | ○ | ○ | ↑ | Δ |
| Ex. 3 | ○ | ○ | Δ (*10) | ○ | Δ (*10) | ↑ | Δ |
| Ex. 4 | ○ | ○ | ○ | ○ | ○ | ↑ | ○ |
| Comp. Ex. 1 | ○ | X | X (*11) | X | X (*11) | ↑ | X |
| Ex. 5 | ○ | ○ | ○ | ○ | ○ | ↑ | ○ |
| Ex. 6 | Δ (*8) | ○ | ○ | ○ | ○ | ↑ | Δ |
| Ex. 7 | ◎ | ○ | ○ | ○ | ○ | Δ (*12) | Δ |

TABLE 2-continued

| | Evaluation | | | | | | |
|---|---|---|---|---|---|---|---|
| | *1 | *2 | *3 | *4 | *5 | *6 | *7 |
| Ex. 14 | ○ | ○ | ○ | ○ | ○ | ↑ | ○ |
| Ex. 15 | Δ (*8) | ○ | ○ | ○ | ○ | ↑ | Δ |
| Ex. 16 | ○ | ○ | ○ | ○ | ○ | ↑ | ○ |
| Ex. 17 | Δ (*8) | ○ | ○ | ○ | ○ | ↑ | Δ |
| Ex. 18 | ○ | ○ | ○ | ○ | ○ | Δ (*12) | Δ |
| Comp. Ex. 2 | X (*9) | ○ | ○ | ○ | ○ | ○ | X |
| Comp. Ex. 3 | X (*9) | ○ | ○ | ○ | ○ | ↑ | X |
| Comp. Ex. 4 | ○ | ○ | ○ | ○ | ○ | X (*13) | X |

TABLE 2-continued

| | Evaluation | | | | | | |
|---|---|---|---|---|---|---|---|
| | *1 | *2 | *3 | *4 | *5 | *6 | *7 |
| Comp. Ex. 5 | ○ | ○ | ○ | ○ | ○ | X (*13) | X |

*1: Image quality,
*2: Luster of printed surface,
*3: Adhesion property after retort,
*4: Susceptibility to scratching,
*5: Adhesion of worked portion,
*6: Productivity,
*7: Overall evaluation,
(*8): ink blurred,
(*9): solid portion dimmed,
(*10): partly peeled,
(*11): wholly peeled,
(*12): bulky facility,
(*13): long time for changing design

INDUSTRIAL APPLICABILITY

The printed seamless cans of the present invention excel in the reproducibility of density of the area solidly printed all-over the surface and in the vividness of image and, further, excel in changing the design, and are suited for use as printed seamless cans that are desired to be produced in small lots having many kinds of designs.

According to the method of producing printed seamless cans of the present invention, it is allowed to partly change the designs easily and in short periods of time making it possible to produce the printed seamless cans for containing beverages that are desired to be produced in small lots having many kinds of designs maintaining good productivity.

Description of Reference Numerals:

| | | |
|---|---|---|
| 1 - ink feed units | 2 - plate cylinders | 3 - blanket |
| 4 - mandrels | 5 - conveyer | 6 - positioning |
| 7 - false baking | 10 - ink-jet heads | 20 - can wall |
| 21 - white coating | 22 - anchor coating | |
| 23 - inks by plate-type printing | | |
| 24 - inks by ink-jet printing | | |
| 25 - finishing varnish layer | | |

The invention claimed is:

1. A printed seamless can forming at least a printed layer and a finishing varnish layer on at least the body portion on an outer surface of the seamless can, said printed layer having an image formed by a plate-type printing and an image formed by an ink-jet printing, and being covered with the finishing varnish layer.

2. The printed seamless can according to claim 1, wherein said seamless can has a white coating formed on the outer surface thereof.

3. The printed seamless can according to claim 1, wherein an anchor coating is formed under said printed layer.

4. The printed seamless can according to claim 1, wherein said printed layer has a portion where the image formed by the plate-type printing is overlapped by the image formed by the ink-jet printing.

5. The printed seamless can according to claim 1, wherein on part of the image of said printed layer formed by the plate-type printing, a mark for positioning the can is formed for conducting the ink-jet printing.

6. The printed seamless can according to claim 5, wherein said mark for positioning the can is formed at a position that is concealed in the double-seaming after the step of double-seaming the can and the lid together.

7. A method of producing a printed seamless can by forming a printed layer on at least the body portion on an outer surface of the seamless can by a plate-type printing and by an ink-jet printing and, thereafter, forming a finishing varnish layer on the printed layer by applying a finishing varnish thereon.

8. The method of producing a printed seamless can according to claim 7, wherein the image formed by said ink-jet printing is false-cured for every feed of ink of each color by the ink jet, and is fully cured after the inks of all colors are fed.

9. The method of producing a printed seamless can according to claim 8, wherein said false-curing is conducted simultaneously with the feed of ink of each color or immediately after the feed of ink of each color but before the feed of ink of a next color.

10. The method of producing a printed seamless can according to claim 7, wherein said printed layer is formed by conducting the ink-jet printing after the plate-type printing has been conducted.

11. The method of producing a printed seamless can according to claim 10, wherein said ink-jet printing is so conducted as to form a portion that overlaps the image formed by the plate-type printing.

12. The method of producing a printed seamless can according to claim 7, wherein on part of the image of said printed layer formed by the plate-type printing, a mark for positioning the can is formed for conducting the ink-jet printing.

13. The method of producing a printed seamless can according to claim 10, wherein the image formed by said plate-type printing is false-baked prior to the ink-jet printing.

14. The method of producing a printed seamless can according to claim 7, wherein said seamless can has a white coating and/or an anchor coating on the outer surface thereof.

* * * * *